United States Patent [19]

Duggan

[11] 4,021,694

[45] May 3, 1977

[54] GETTERED INCANDESCENT LAMP AND METHOD OF MAKING SAME

[75] Inventor: George L. Duggan, Bedford, Mass.

[73] Assignee: GTE Sylvania Incorporated, Danvers, Mass.

[22] Filed: Dec. 29, 1975

[21] Appl. No.: 644,892

[52] U.S. Cl. ..... 313/181; 313/180

[51] Int. Cl.[2] ..... H01J 19/68

[58] Field of Search ..... 313/181, 180, 174

[56] References Cited

UNITED STATES PATENTS

| | | | |
|---|---|---|---|
| 1,636,054 | 7/1927 | Holden | 313/181 |
| 1,965,583 | 7/1934 | Foulke | 313/181 X |
| 2,073,885 | 3/1937 | Spanner et al. | 313/180 X |
| 2,222,005 | 11/1940 | Sutherlin | 313/180 |
| 2,444,423 | 7/1948 | Braunsdorff | 313/180 X |
| 2,489,261 | 11/1949 | Braunsdorff | 313/180 X |
| 2,533,387 | 12/1950 | McLean | 313/181 X |

*Primary Examiner*—Stanley T. Krawczewicz
*Attorney, Agent, or Firm*—James H. Grover

[57] ABSTRACT

In assembly of an incandescent lamp with a conventionalglass envelope, filament and filament supporting lead wires, a wire, ribbon or like strip of metallic getter material is electrically connected between the lead wires in parallel with the filament. The getter strip is of a metallic material having a vapor pressure greater than one hundredth Torr at its melting point. After assembly electrical current is flashed through the lead wires and getter strip resistively heating the strip to vaporization and dispersing the getter metal in atomic state toward the interior walls and other locations within the lamp envelope. In transit to the walls the atomic metal adds to the gettering action at vaporization. And after flashing, the getter metal is deposited at reactive getter sites distributed throughout the interior of the lamp for continued gettering action during lamp operating life.

15 Claims, 3 Drawing Figures

GETTERED INCANDESCENT LAMP AND METHOD OF MAKING SAME

BACKGROUND OF THE INVENTION

In the manufacture of incandescent lamps the heating of metals and metallic alloys and compounds within the assembled and sealed lamp has long been employed to remove contaminants from the partial vacuum or other gaseous fill sealed within the lamp envelope. The contaminants occur in the atmosphere within the envelope and during a manufacturing flashing process are boiled from the incandescent lamp filament and its supporting lead wires. After flashing and during lamp burning additional contaminants appear which prior gettering methods do not efficiently remove from the lamp.

For example R. K. Braunsdorf, in U.S. Pat. No. 2,489,261, describes a zirconium family getter wire connected across the filament support wires. Simultaneously with flashing of the filament by supplying current through the support wires the getter wire is brought to incandescence, avoiding volatilization, and fused to small balls. Continued gettering is attributed to the fused balls but their active surface is minimized by their spherical shape. Similarly in U.S. Pat. No. 2,913,277 to R. H. Atkinson a gettering strip is resistively heated to below its melting point and melted to residual small bodies at their original site, avoiding volatilization. No subsequent gettering is attributed to the residual getter material.

Accordingly the object of the present invention is to provide a lamp as an intermediate and as a final product, and a method of treating the lamp which affords improved gettering action at the time of lamp flashing and substantially larger gettering areas during the operating life of the lamp.

STATEMENT OF INVENTION

According to the invention an incandescent lamp as an intermediate product comprises an envelope, a filament, conducting wires supporting the filament in the envelope, and a strip of getter metal having a vapor pressure at melting point greater than one hundredth Torr electrically connected between the supporting wires, the strip being capable of being resistively heated by current through the strip from the wires so as to vaporize the strip and disperse the metal in atomic state to reactive getter deposition sites on the interior surface of the envelope.

Further a method of treating the lamp as an intermediate product comprises applying electrical current through the supporting wires and getter strip effective to resistively heat the strip rapidly to boiling point so as to vaporize the metal strip in atomic state for gettering action in transit to the envelope, and to deposit the metal in reactive form at getter sites distributed over the interior surface of the envelope.

A lamp treated according to the invention comprises an envelope, a filament, and supports for the filament within the lamp envelope, wherein a getter metal having a vapor pressure at its melting point greater than one hundredth Torr is distributed in atomic state at sites throughout the interior surface of the envelope in reactive form for continued gettering substantially throughout the operative life of the lamp.

DRAWINGS

DESCRIPTION

Figure 1:
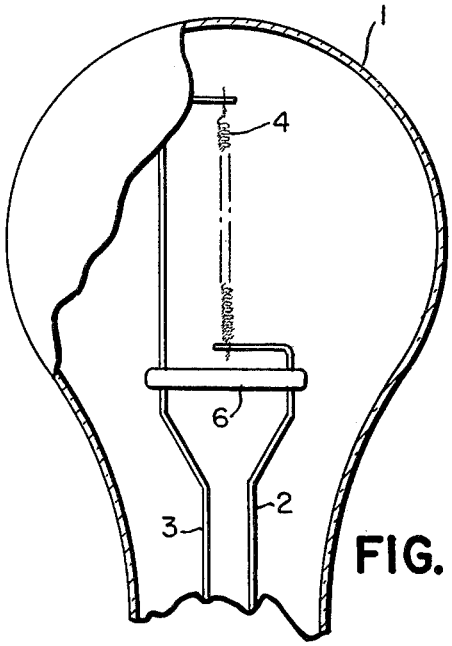
FIG. 1 is an elevation, partly broken away, showing an incandescent lamp in manufacture according to the invention.

In FIG. 1 is shown a typical incandescent lamp structure during manufacture prior to flashing. The lamp consists of a glass envelope 1, a pair of lead wires 2 and 3 sealed in the stem of the envelope, a coiled tungsten filament 4 suspended between the lead wires, and a strip 6 of getter material welded or crimped at each end to one of the lead wires so as to be electrically connected between the lead wires in parallel with the filament. The envelope may be evacuated or may contain a gas fill such as of argon and 4 to 14% nitrogen. Even after good evacuation or gas flushing it will also initially contain contaminating gases and vapors such as water, oxygen, carbon monoxide and dioxide which cloud the internal lamp atmosphere and may react with the other internal lamp parts, of most concern being the tungsten filament. Such contamination will also evaporate from the filaments, its supporting leads and the envelope or its frosted coating during operation of the lamp. Much of the contamination of the initial fill and of the subsequently evaporated contamination may be removed by resistively heating and fusing the getter strip 6 concomitantly with resistive heating of the lead wires and filament to drive out adsorbed contaminant gases. Various chemically active materials, particularly metals and alloys heated close to melting point will absorb the contaminants then present. The getter strip 6 will also fuse open during heating and break the electrical connection through the getter strip between the lead wires 2 and 3. As mentioned in describing the background of the invention substantial gettering action then ceases in prior incandescent lamps.

With the present lamp however, additional gettering action is afforded during flashing and continued lamp operation by selection of the getter strip metal and the method of activating the strip.

According to one aspect of the invention the getter strip material is selected from metals having a vapor pressure at melting point greater than one hundredth of a Torr ($10^{-2}$ p.s.i.), preferably selected from Group IIA or IIB elements of the periodic table.

And secondly the metal getter strip is activated by rapid heating to the point of vaporization.

The material of the getter strip 6 is preferably magnesium having a vapor pressure of about 1.3 Torr at its melting point, and a boiling point at about 1100° C, or zinc having a vapor pressure of 0.12 Torr at melting point and a boiling point at about 900° C. For a 100 watt lamp typically the strip is in the form of wire three quarters of an inch in length and 1 to 3 mils in diameter or a ribbon of the same length and cross section but of greater surface area.

Figure 2:
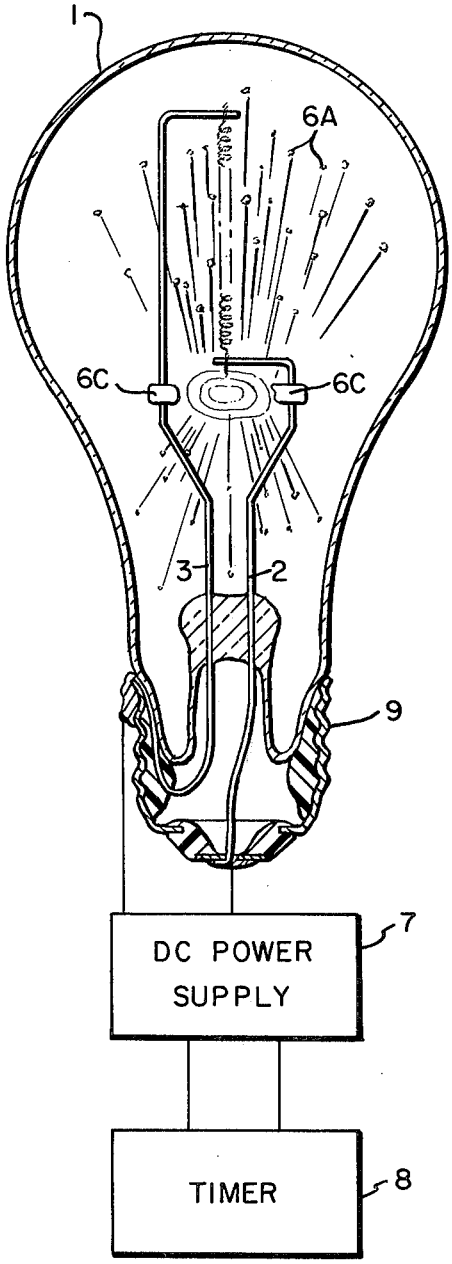
FIG. 2 is an elevation like FIG. 1 illustrating treatment of the lamp.
Figure 3:
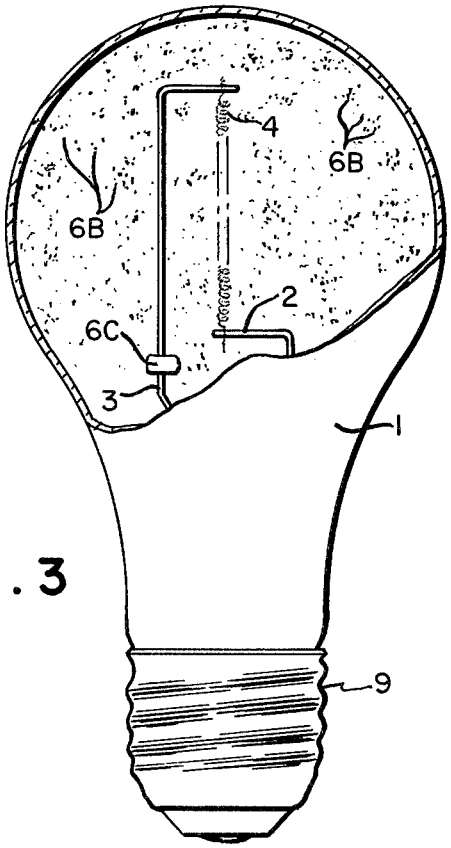
FIG. 3 is an elevation showing the treated lamp.

As shown in FIG. 2 the getter strip 6 is activated by resistive heating from a DC flashing power supply 7 cycled by a timer 8. The timer causes the power supply to apply current through a lamp base 9 to the lead wires 2 and 3 in two or more steps of several seconds each from 50 to about 130 volts. Beginning with the lower voltage steps the filament is flashed and recrystallized, contamination boiled from the filament and leads, and in the highest step a getter of the materials and dimensions described is rapidly volatilized and getter atoms 6A are violently evaporated away from the original getter strip. Normal gettering of contaminants occurs while the original getter strip passes through melting point to vaporization. Additional gettering occurs during transit of the volatilized atoms toward the envelope and other parts inside the envelope. The volatilized atoms are then deposited in many sites 6B (FIG. 3) distributed over the interior surface of the envelopes and other internal lamp parts. The getter material at these deposition sites is not only widely distributed but also presents in the aggregate a large gettering surface area in contrast to the small surface area per volume of the residual stubs 6C of the getter strip 6.

The distributed, deposited getter sites are therefore reactive and provide continued gettering throughout the operative life of the lamp. After life tests using comparable lamps with prior getters as controls distinctly longer luminous maintenance and useful life was found with lamps according to the present invention. Zinc was found to be especially effective.

It should be understood that the present disclosure is for the purpose of illustration only and that this invention includes all modifications and equivalents which fall within the scope of the appended claims.

I claim:

1. An incandescent lamp as an intermediate product comprising an envelope, a filament, conducting wires supporting the filament in the envelope, and a strip of getter metal having a vapor pressure at melting point greater than one hundredth Torr electrically connected between the supporting wires, the strip being dimensioned to form an electrical resistance effective to heat rapidly by current through the strip from the wires so as to violently vaporize the strip and disperse the metal in atomic state to many widely distributed reactive getter deposition sites on the interior surface of the envelope.

2. A lamp according to claim 1 wherein the getter strip is a metal selected from the periodic table group II consisting of magnesium and zinc.

3. A lamp according to claim 1 wherein the getter strip resistance is effective to heat the strip to volatilization at a voltage flashing the lamp filament.

4. A lamp according to claim 3 wherein the getter strip resistance is effective to violently volatilize getter metal atoms in reactive gettering state away from the strip to the lamp envelope.

5. A lamp according to claim 1 having in proportion to a one hundred watt filament a getter strip approximately three quarters of an inch in length and one to three mils in effective diameter.

6. A method of treating an incandescent lamp as an intermediate product having an envelope, a filament, conductive wires supporting the filament within the envelope, and a strip of getter metal having a vapor pressure at melting point greater than one hundredth Torr electrically connected between the supporting wire, the method comprising applying electrical current through the supporting wires and getter strip effective to resistively heat the strip rapidly to boiling point so as to vaporize the metal strip in atomic state for gettering action in transit to the envelope, and to deposit the metal in reactive form at getter sites widely distributed over the interior surface of the envelope.

7. The method according to claim 6 wherein the power of the applied current is effective to flash the lamp filament.

8. The method according to claim 6 wherein the power of the applied current is above the value of initial filament flashing.

9. The method according to claim 6 wherein the electrical current is applied at a voltage effective to violently volatilize getter metal atoms in reactive gettering state away from the strip to widely distributed sites within the lamp envelope.

10. The method according to claim 9 wherein substantial areas of reactive getter material are deposited over the interior surface of the lamp envelope.

11. The method according to claim 6 wherein the getter strip is heated resistively only.

12. The method according to claim 6 wherein the getter strip is selected from the periodic group II metals consisting of magnesium and zinc.

13. An incandescent lamp comprising an envelope, a filament, and supports for the filament within the lamp envelope, wherein a getter metal having a vapor pressure at its melting point greater than one hundredth Torr is widely distributed in atomic state at sites throughout the interior surface of the envelope in reactive form for continued gettering substantially throughout the operative life of the lamp.

14. A lamp according to claim 13 wherein the getter is selected from the periodic table group metals consisting of magnesium and zinc.

15. A lamp according to claim 13 wherein the area per volume of the distributed getter is large compared to residual unvolatilized getter material.

* * * * *